US005345882A

United States Patent [19]

Yamada

[11] Patent Number: 5,345,882

[45] Date of Patent: Sep. 13, 1994

[54] ASSEMBLY-TYPE TABLE

[75] Inventor: Tetsuya Yamada, Okayama, Japan

[73] Assignee: Sanwa Supply Co., Ltd., Okayama, Japan

[21] Appl. No.: 19,108

[22] Filed: Feb. 18, 1993

[30] Foreign Application Priority Data

Feb. 19, 1992 [JP] Japan ..... 4-32242

[51] Int. Cl.[5] ..... A47B 3/00

[52] U.S. Cl. ..... 108/193; 108/180

[58] Field of Search ..... 108/111, 153, 157, 159, 108/180, 86, 187, 189, 192, 193; 312/257.1, 263

[56] References Cited

U.S. PATENT DOCUMENTS

| | | | |
|---|---|---|---|
| 900,247 | 10/1909 | Williams | 108/157 X |
| 3,966,285 | 6/1976 | Porca et al. | 312/265.4 |
| 4,125,338 | 11/1978 | Lew | 312/263 X |
| 4,515,280 | 5/1985 | Shen | 108/111 |
| 5,056,672 | 10/1991 | Yamada . | |

FOREIGN PATENT DOCUMENTS

| | | | |
|---|---|---|---|
| 155372 | 9/1985 | European Pat. Off. | 312/263 |
| 1221849 | 6/1960 | France | 312/263 |
| 59-16428 | 1/1984 | Japan . | |
| 60-91040 | 6/1985 | Japan . | |
| 1251681 | 10/1971 | United Kingdom | 312/263 |

*Primary Examiner*—Jose V. Chen
*Attorney, Agent, or Firm*—Koda and Androlia

[57] ABSTRACT

A table which can be easily assembled without much labor for screw fastening or such operations is provided. For this purpose, pins are provided on lower portions of the inner surfaces of both side frames which constitute the table, and slots are formed in upper portions thereof and opened upwardly, while slots which are opened downwardly to be closely fitted on the pins of the side frames are formed in lower portions of a rear frame on both sides, and pins to be closely fitted in the slots in the upper portions of the side frames are provided on upper portions of the rear frame on both sides. The rear frame is connected to both the side frames. Then, side pins are provided on rear portions of both the side frames, and upwardly projecting pins are provided on front portions thereof, while engagement plates whose free-end portions can be inserted under the side pins are provided on both side portions of a table panel on the rear side at positions corresponding to the side pins, and push nuts are provided on both side portions of the table panel on the front side at positions corresponding to the upwardly projecting pins. The table panel is connected to both the side frames.

1 Claim, 4 Drawing Sheets

ASSEMBLY-TYPE TABLE

BACKGROUND OF THE INVENTION

1. Industrial Field of the Invention

The present invention relates to a simple but convenient assembly-type table for desk work, computers, and mainly for office use.

2. Prior Art

A table which is assembled by screw fastening and finished as a product is bulky. Conventionally, therefore, component parts such as side frames, a rear frame and a table panel are kept in non-assembled states during transportation from factories and assembled at an installation site. In such a case, when the number of component parts per table or the number of tables to be assembled is large, labor for screw fastening, i.e., assembling labor is increased.

Needless to say, various inventions have been achieved to lessen the number of screw-fastening portions. A folding-type table is disclosed, for example, in U.S. Pat. 5,056,672 and so forth.

Another type has a table panel which is vertically slidable with respect to side panels, so that the level of the table panel can be controlled, and that the table panel can be disassembled/detached. (Examples of this type are disclosed in Japanese Utility Model Unexamined Publication Nos. 59-16428 and 60-91040.)

It is an object of this invention to develop a table which can be easily assembled without much labor for screw fastening or such operations.

SUMMARY OF THE INVENTION

An assembly-type table according to the present invention has a structure in which pins are provided on lower portions of the inner surfaces of both side frames which constitute the table, and slots are formed in upper portions thereof and opened upwardly, while slots which are opened downwardly to be closely fitted on the pins of the side frames are formed in lower portions of a rear frame on both sides, and pins to be closely fitted in the slots in the upper portions of the side frames are provided on upper portions of the rear frame on both sides.

The above-mentioned side frames can have different configurations. For example, both the side frames may be plate-like structures, or both of them may simply consist of frames, or one of the side frames may include drawers, shelves or structures which satisfy other purposes.

Likewise, the rear frame can have different configurations. For example, it may be a plate-like structure, or it may simply consist of frames, or it may be composed of an outer frame alone.

Further, the assembly-type table according to the invention has a structure in which side pins are provided on rear portions of both the side frames which constitute the table, and upwardly projecting pins are provided on front portions thereof, while, concerning a table panel to be mounted on the side frames, engagement plates whose free-end portions can be inserted under the side pins are provided on both side portions of the table panel on the rear side at positions corresponding to the side pins, and push nuts are provided on both side portions of the table panel on the front side at positions corresponding to the upwardly projecting pins.

With this structure, the side frames and the rear frame can be surely connected simply by inserting the rear frame between the side frames which constitute the table and moving it downwardly. After that, the table can be completed only by mounting the table panel on the frames.

The engagement plates on the rear portion of the table panel are brought into contact with the side pins on the rear portions of both the side frames and inserted under them, and then, the push nuts are closely fitted on the upwardly projecting pins simply by moving the front portion of the table panel downwardly. Thus, the table panel is fixed on the frames.

As a result, the table can be assembled easily in short time without using a screw-fastener, and it can have a surely connected state. Moreover, depending upon the construction of a table, only one of the above-described assembling methods for connecting the side and rear frames and for connecting the frames and the table panel can be employed, to thereby decrease the labor to a considerable degree.

DETAILED DESCRIPTION OF THE INVENTION

Figure 1:
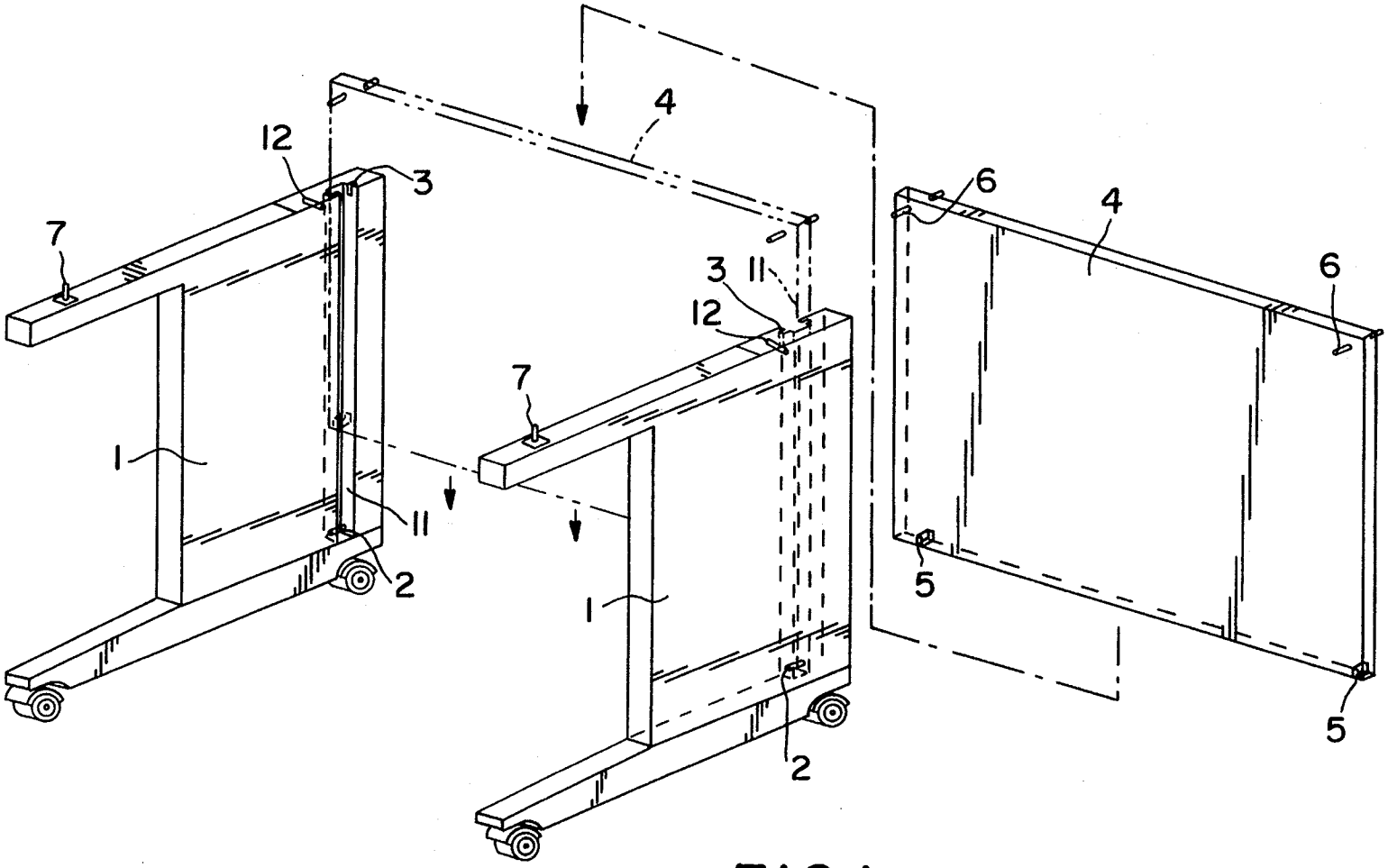
FIG. 1 is a perspective view showing side frames and a rear frame of an assembly-type table according to the present invention when they are assembled.

FIG. 1 is a perspective view showing a structural example of side frames and a rear frame of an assembly-type table according to the present invention, and a condition of these frames when they are assembled. Vertical grooves in which the rear frame can be inserted from above are formed in the inner surfaces of both the sides frames 1 which constitute the table. Pins are provided on lower portions of the grooves and extended in the direction from the front side to the rear side of the table. As shown in an enlarged view of FIG. 3, slots 3 which are opened upwardly are formed on upper portions of the grooves 11.

On the other hand, slots 5 which are opened downwardly to be closely fitted on the pins 2 of both the side frames are formed on lower portions of the rear frame 4 on both sides. Pins 6 to be closely fitted in the slots 3 on the upper portions of the side frames are provided on upper portions of the rear frame 4 on both sides and projected forwardly and backwardly in the plate-thickness direction.

With such a structure, as indicated by a chain line in FIG. 1, when the rear frame 4 is inserted between the side frames 1 from above and moved downwardly, the slots 5 of the rear frame 4 are closely fitted on the pins 2 on the inner lower portions of the side frames 1, and the pins 6 of the rear frame 4 are closely fitted in those slots 3 of the side frames 1 which are opened upwardly, so that the side frames and the rear frame will be assembled surely.

Figure 2:
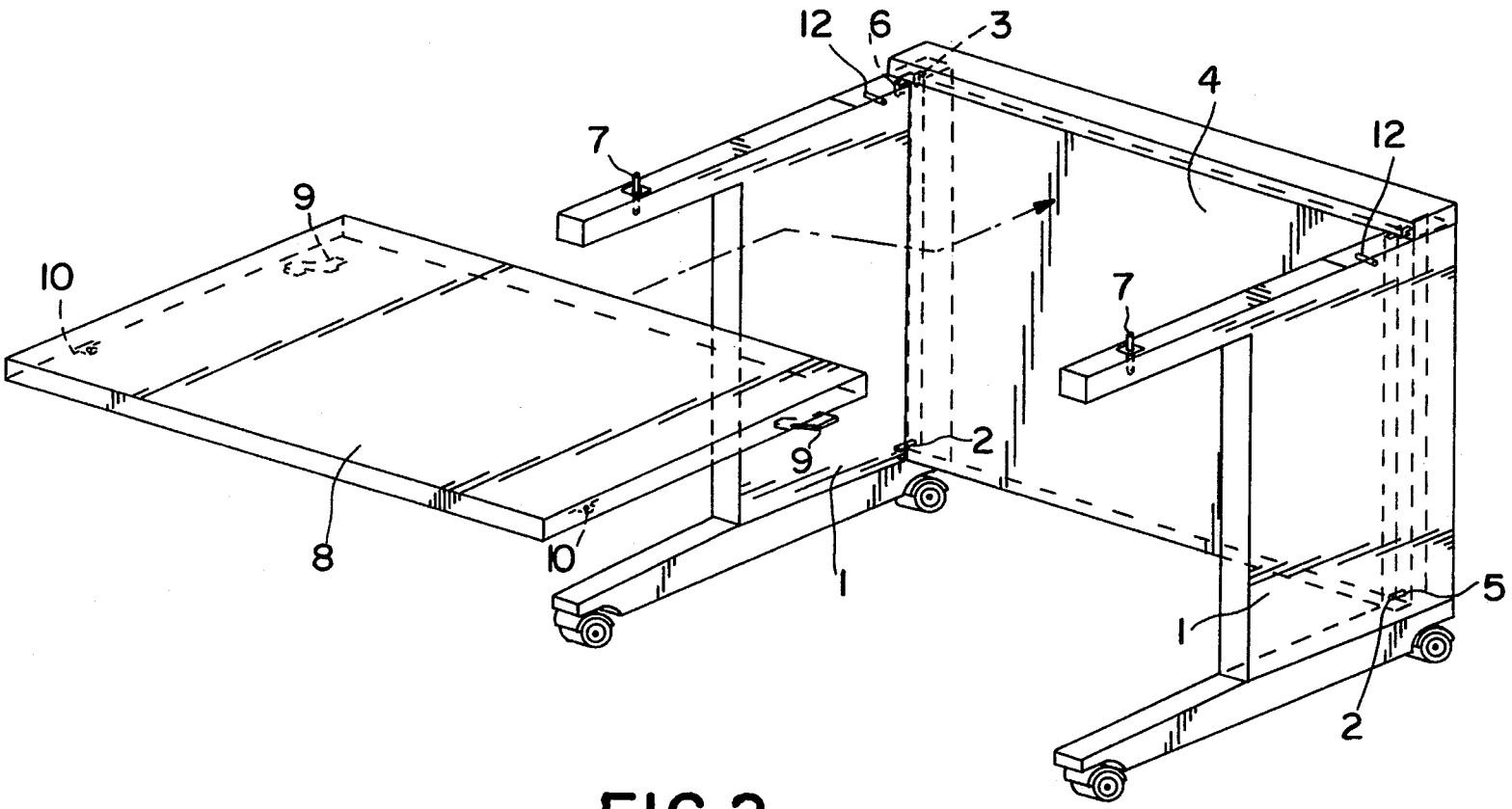
FIG. 2 is a perspective view showing a condition when a table panel of the assembly-type table according to the invention is connected.
Figure 3:
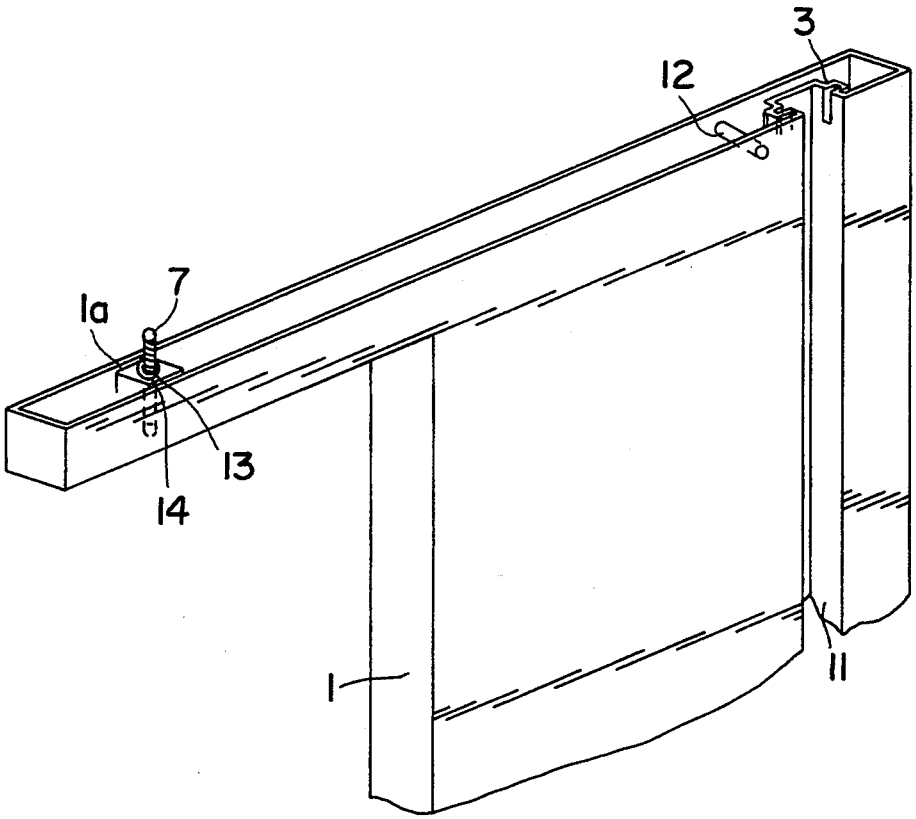
FIG. 3 is a perspective view showing an upper portion of a side frame which constitutes the table.
Figure 4:
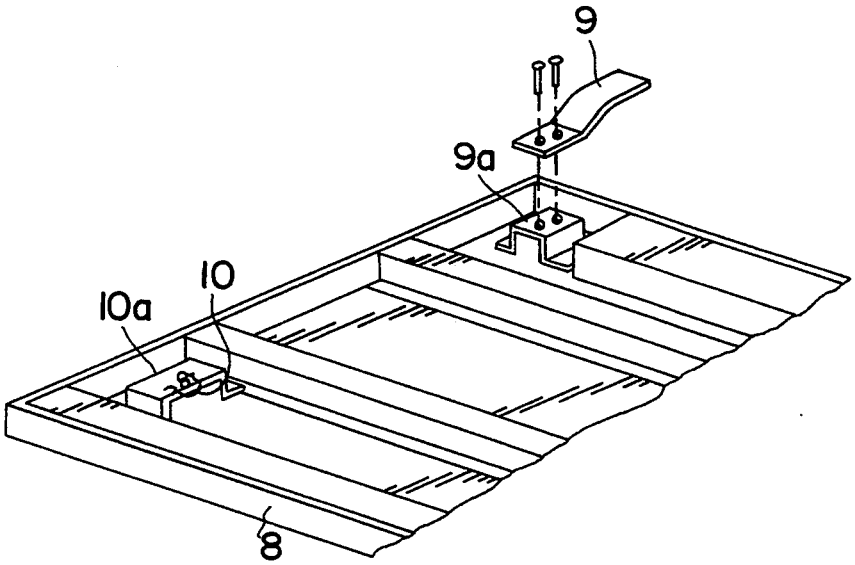
FIG. 4 is a perspective view showing the rear surface of the table panel.

FIG. 2 is a perspective view showing a condition when a table panel is connected after the operation illustrated in FIG. 1. Insertion holes 1*a* are formed in upper portions of both the side frames 1 which constitute the table. As shown in FIG. 3 more specifically, the insertion holes 1*a* on the rear side serve to hold side pins 12, whereas the insertion holes 1*a* on the front side serve to hold upwardly projecting pins 7. Referring to FIG. 4 showing a condition of the rear surface of the table panel 8, fixed portions 9*a* of engagement plates 9, each consisting of an inclined portion and a horizontal portion, are provided on both side portions of the table panel 8 on the rear side at positions corresponding to the side pins 12 in such a manner that free-end portions of the engagement plates 9 can be inserted under the side pins 12 of the side frames. Locating portions 10*a* of push nuts 10 are provided on both side portions of the table panel 8 on the front side at positions corresponding to the upwardly projecting pins 7 of the side frames.

Figure 5:
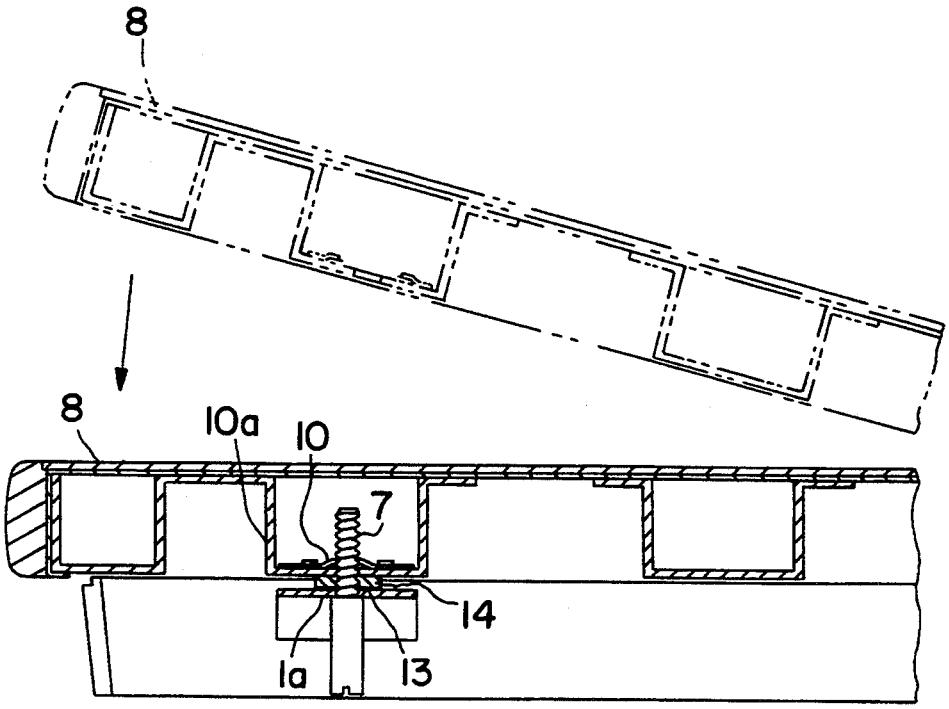
FIG. 5 is a cross-sectional view showing a condition when a projecting pin and a push nut are closely fitted with each other.

FIG. 5 illustrates a condition when each of these projecting pins 7 is closely fitted in the push nut 10. The projecting pin 7 is inserted in the insertion hole 1*a* of the side frame 1 from below. A metallic E-ring (or C-ring) 13 for preventing the projecting pin 7 from coming off is fitted on that upper projecting portion of the projecting pin 7 which is screw-threaded, and a rubber ring 14 serving as a rubber cushion is fitted on the metallic E-ring 13. The push nut 10, which has a structure of a belleville spring with an opening in which the screw-threaded portion of the projecting pin 7 will be fitted, is fixed on the rear surface of the table panel 8 on the front side.

With the above-described structure, as shown in FIG. 5, the rear portion of the table panel 8 is moved close to the side pins 12 on the rear portions of the side frames 1 while it is inclined in such a manner as to bring the engagement plates 9 into contact with the side pins 12. The free-end portions of the engagement plates 9 are inserted under the side pins 12 and moved until they are engaged with each other. Subsequently, when the front portion of the table panel 8 is moved downwardly, the push nuts 10 are closely fitted on the upwardly projecting pins 7, and the table panel 8 is fixed instantaneously.

With the entire structure described above, the assembly-type table according to the present invention is characterized in that screw fastening or such operations are not necessary, so as to lessen the assembling labor, and that the assembly-type table has such a simple structure that any one can assemble it easily.

What is claimed is:

1. An assembly-type table comprising two side frames located on left and right sides, a rear frame for supporting said side frames, and a table top panel removably mounted and fixed on said side frames wherein:

a vertical groove is formed in a rear inner surface of each one of said side frames and has a pin at a bottom of said vertical groove and an upwardly opened slot at a top of said vertical groove, two slots are formed at a bottom of said rear frame so as to engage with said pins of said side frames, and two pins are formed at a top of said rear frame so as to engage with said slots of said side frames, so that said rear frame is fixed to said side frames when both side edges of said rear frame are slid into said vertical grooves of said side frames; and said side frames are further provided with side pins at upper rear portions thereof and upwardly projecting pins at upper front portions thereof, and said table top frame is provided with engagement plates on an under surface thereof at positions that correspond to said side pins of said side frames and with push nuts on an under surface thereof at positions that correspond to said projecting pins of said side frames, so that said table top panel is fixed to said side frames when said engagement plates are inserted under said side pins and said push nuts are engaged with said projecting pins by pushing said top panel from above.

* * * * *